US010358915B2

(12) United States Patent
Stark et al.

(10) Patent No.: US 10,358,915 B2
(45) Date of Patent: Jul. 23, 2019

(54) SINGLE SOURCE FULL-DUPLEX FIBER OPTIC TELEMETRY

(71) Applicant: Halliburton Energy Services, Inc., Houston, TX (US)

(72) Inventors: Daniel Joshua Stark, Houston, TX (US); Aaron Michael Fisher, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/061,721

(22) PCT Filed: Mar. 3, 2016

(86) PCT No.: PCT/US2016/020661
§ 371 (c)(1),
(2) Date: Jun. 13, 2018

(87) PCT Pub. No.: WO2017/151134
PCT Pub. Date: Sep. 8, 2017

(65) Prior Publication Data
US 2018/0363458 A1 Dec. 20, 2018

(51) Int. Cl.
*E21B 47/12* (2012.01)
*H04B 10/25* (2013.01)
(Continued)

(52) U.S. Cl.
CPC ..... *E21B 47/123* (2013.01); *E21B 47/0006* (2013.01); *E21B 49/00* (2013.01)

(58) Field of Classification Search
None
See application file for complete search history.

(56) References Cited

U.S. PATENT DOCUMENTS 4,389,645 A 6/1983 Wharton
4,547,774 A 10/1985 Gould
(Continued)

FOREIGN PATENT DOCUMENTS

GB 2386013 A2 9/2003
GB 2474219 A 4/2011
(Continued)

OTHER PUBLICATIONS

Lutovac et al. "Classic Analog Filter Design". Filter Design for Signal Processing Using MATLAB and Mathematica. Upper Saddle River, New Jersey. 2001, pp. 142-153.
(Continued)

*Primary Examiner* — Muhammad N Edun
*Assistant Examiner* — Jerold B Murphy
(74) *Attorney, Agent, or Firm* — Haynes and Boone, LLP

(57) ABSTRACT

A full-duplex borehole communication system includes a single light source to generate a light signal. A downlink modulator is coupled to the light source to modulate the light signal in response to downlink data using a first protocol to generate a first modulated light signal. An uplink modulator is coupled to the downhole modulator to modulate the first modulated light signal in response to uplink data using a second protocol to generate a second modulated light signal. A downlink receiver is coupled to the downlink modulator to demodulate the first modulated signal to recover the downlink data. An uplink receiver is coupled to the uplink modulator and configured to demodulate the second modulated light signal to recover the downlink data and the uplink data. Asymmetric protocols are used between the downhole portion of the system and the uphole portion.

20 Claims, 13 Drawing Sheets

(51) Int. Cl.
*E21B 47/00* (2012.01)
*E21B 49/00* (2006.01)

(56) References Cited

U.S. PATENT DOCUMENTS

| | | | | |
|---|---|---|---|---|
| 4,709,413 | A | 11/1987 | Forrest et al. | |
| 5,808,779 | A * | 9/1998 | Weis | E21B 47/123 356/32 |
| 6,747,569 | B2 | 6/2004 | Hill et al. | |
| 7,420,475 | B2 | 9/2008 | Adnan et al. | |
| 7,515,774 | B2 | 4/2009 | Vannuffelen et al. | |
| 7,720,323 | B2 | 5/2010 | Yamate et al. | |
| 7,929,812 | B2 | 4/2011 | Vannuffelen et al. | |
| 8,274,400 | B2 * | 9/2012 | Wilson | H04B 10/2504 166/244.1 |
| 8,536,516 | B2 * | 9/2013 | Ford | G01J 3/02 250/256 |
| 8,588,619 | B2 | 11/2013 | Peter et al. | |
| 2002/0196993 | A1 | 12/2002 | Schroeder | |
| 2003/0011489 | A1 | 1/2003 | Viswanathan | |
| 2008/0143552 | A1 | 6/2008 | Mallison et al. | |
| 2009/0038794 | A1 * | 2/2009 | Yamate | E21B 47/123 166/254.2 |
| 2009/0224936 | A1 * | 9/2009 | Vannuffelen | E21B 47/123 340/854.7 |
| 2010/0018703 | A1 | 1/2010 | Lovell et al. | |
| 2010/0194586 | A1 | 8/2010 | Tjhang et al. | |
| 2010/0194588 | A1 | 8/2010 | Menezes et al. | |
| 2011/0139447 | A1 | 6/2011 | Ramos et al. | |
| 2011/0140907 | A1 | 6/2011 | Louden | |
| 2012/0039561 | A1 | 2/2012 | MacDougall et al. | |
| 2014/0193153 | A1 | 7/2014 | Hosoda | |
| 2015/0126107 | A1 | 5/2015 | Bennett et al. | |

FOREIGN PATENT DOCUMENTS

| | | | |
|---|---|---|---|
| WO | WO 2001/058078 | A1 | 8/2001 |
| WO | WO 2011/094134 | A2 | 8/2011 |

OTHER PUBLICATIONS

Lutovac et al. "Classic Digital Filter Design". Filter Design for Signal Processing Using MATLAB and Mathematica. Upper Saddle River, New Jersey. 2001, pp. 330-346.

International Search Report and The Written Opinion of the International Search Authority, or the Declaration, dated Nov. 24, 2016, PCT/US2016/020661, 18 pages, ISA/KR.

Shaheen et al., "An Engineering Approach to Utilize Fiber Optics Telemetry Enabled Coiled Tubing (ACTive Technology) IN Well Testing and Sand Stone Matrix Stimulation—First Time in the World" https://www.onepetro.org, 2012, pp. 1-13.

Wireless Communication by Andrea Goldsmith (8th printing, Ch. 12 and 13).

* cited by examiner

SINGLE SOURCE FULL-DUPLEX FIBER OPTIC TELEMETRY

BACKGROUND

In drilling wells for oil and gas exploration, understanding the structure and properties of the associated geological formation provides information to aid such exploration. Logging measurements may be performed in a borehole to obtain this information. However, the environment in which the drilling tools operate and where measurements are made may be located at significant distances below the surface. It may be desirable to transmit downhole logging measurements to the surface for analysis and control purposes.

Electrical cables have been investigated for high speed telemetry to and from downhole tools. Use of electrical cables for such communication, however, has drawbacks due to limitations with information bandwidth and electromagnetic interference.

DETAILED DESCRIPTION

Some of the challenges noted above, as well as others, may be addressed by using the single source full-duplex fiber optic communication system for communicating between an uphole location and a downhole environment. By using non-symmetrical protocols between the surface and downhole, telemetry may be transmitted downhole and uphole substantially simultaneously on the same fiber using a single light source. For example, different downlink and uplink data rates and/or different downlink and uplink modulation schemes may be used.

Figure 1:
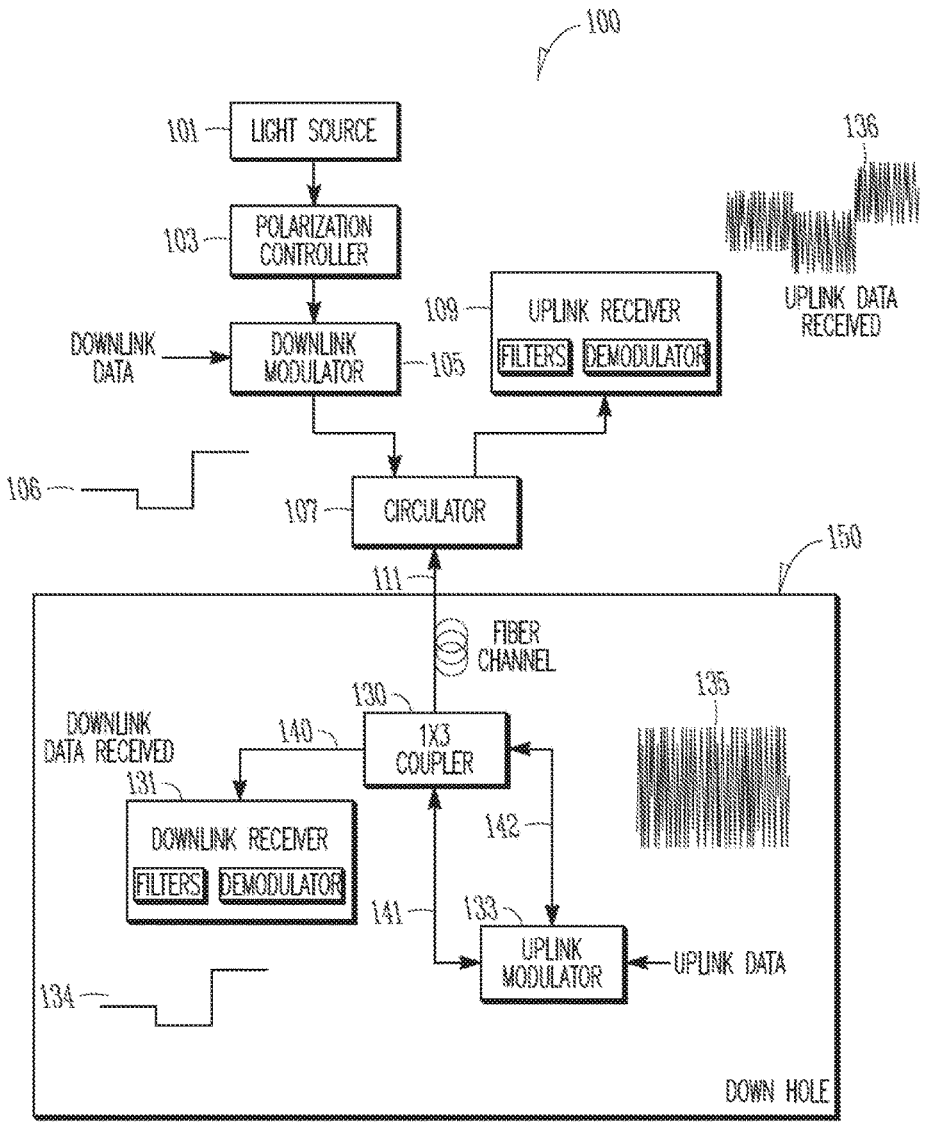
FIG. 1 is a block diagram showing a single light source full-duplex fiber optic communication system, according to various embodiments.

FIG. 1 is a block diagram showing a single light source 101 full-duplex fiber optic communication system, according to various embodiments. The block diagram is for illustration purposes only since different components having a substantially similar function may be substituted for the illustrated components.

The system may be broken up into an uphole (i.e., surface) portion 100 and a downhole (i.e., borehole) portion 150. While certain components are shown in either the surface 100 or the downhole 150 portions, the system embodiments are not restricted to any such implementation. For example, a single light source 101 may be located either downhole 150 or on the surface 100.

The surface portion 100 comprises the single light source 101. The light source 101 (e.g., lasers, light emitting diode (LED), amplified spontaneous emission (ASE)) generates a light signal for transmission through the system. Only the single light source 101 is used and is constantly transmitting the light signal. The light source 100 operates at wavelengths between 800 nanometers (nm) and 1700 nm and operates with coherence lengths between 1 micrometer (μm) and 2000 kilometers (km).

A polarization controller 103 is coupled to the light source 101. In an embodiment, optical filters, optical isolators, optical attenuators, optical amplifiers, and/or other optical devices may be added after the polarization controller 103. The polarization controller 103 is configured to adjust a polarization of the light signal to generate a polarized light signal for optimal use in the system. The polarization controller 103 may adjust the light signal polarization manually or by electrical control signals, with or without automatic feedback. For example, feedback of fiber strain, compression, torsion, and/or temperature may be used by the polarization controller 103 to adjust the light polarization. The polarization controller 103 may transform a fixed, known polarization into an arbitrary one or vice versa. The polarization controller 103, in other embodiments, may scramble the polarization by oscillating the output of the polarization controller 103 very fast (as compared to the sampling rates). Depending on the type of light source, it may be desirable to control the polarization, scramble the polarization, or use a depolarized light source.

A downlink modulator 105 is coupled to the polarization controller 103. The downlink modulator 105 modulates the light signal in response to downlink data 106, using a first protocol, to generate a downlink modulated light signal for transmission downhole over a fiber channel 111. The light signal may be optical amplitude modulated, wavelength modulated, phase modulated, or some combination of these, by the downlink data 106. In an embodiment, the downlink data 106 may include commands to be transmitted to a tool downhole.

The downlink modulator 105 encodes the downlink data by adjusting the amplitude, phase, and/or wavelength of passing light based on the downlink data voltage. The modulator 105 includes an electro-optic modulator, an electro-absorption modulator, a ring resonator, a semiconductor optical amplifier, an optical switch, and/or a fiber attenuator to perform the modulation. The modulator 105 operates from 400 nm to 2500 nm; modulates from 1 Hz to 100 GHz, and maintains polarization or is polarization insensitive.

A circulator 107 is coupled to the downlink modulator 105. The circulator 107 directs light from the modulator 105 to the fiber optic channel 111 and from the fiber optic channel 111 into a receiver 109. For example, the circulator 107 couples the downlink modulated light signal to a downhole coupler 130 and an uplink modulated signal to the uplink receiver 109. The circulator 107 may be any commercially available circulator centered at the wavelength of operation.

The uplink receiver 109, coupled to the circulator 107, converts optical power to voltages for processing by other circuitry (e.g., filters, demodulators). The receiver 109 includes a photodiode, a photomultiplier tube or a thermopile for detecting the received light and converting to the associated voltages based on the detected amplitude. The receiver 109 may operate from 400 nm to 2500 nm, detects signals from 1 Hz to 100 GHz, and has sensitivity between 0 dBm and −80 dBm. The receiver may be cooled using Peltier coolers, heat sinks, dissipation fans, or cryocoolers.

The optical fiber channel 111 may be pure silica or doped with erbium, ytterbium, neodymium, boron, quantum dots, nanoparticles, or some other dopant. The fiber channel 111 may be single mode, multimode, or polarization maintaining. The fiber channel 111 may be jacketed with polyimide, silicone-PFA, graphene, boron nitride, carbon composite, or combination thereof and be part of a larger composite cable that can include electrically conducting lines, other optical fibers, sensors, or structural support. The electrically conducting lines may be separated from the optical fibers.

The downhole portion 150 is coupled to the surface portion 100 through the fiber optic channel 111. Depending on the implementation, a fiber optic rotary joint may be used to connect the surface portion 100 to the downhole portion 150 when the surface optical system is stationary. In another embodiment, an electrical slip ring may connect electrical controls of a truck to electrical controls of the system when the optical system is in a cable spool. The downhole portion 150 includes an optical coupler 130 (e.g., 1×3), a downlink receiver 131, and an uplink modulator 133.

The optical coupler 130 is coupled to the fiber channel 111 to split the light signal from the single channel 111 into three channels 140-142 and recombines the light from two of the channels 141, 142 into one channel 111. The coupler may be made of pure silica or doped with erbium, ytterbium, neodymium, boron, quantum dots, nanoparticles, or some other dopant. The coupler 130 may be single mode, multimode, or polarization maintaining and jacketed with polyimide, silicone-PFA, graphene, boron nitride, carbon composite, or combination thereof. Other embodiments may use two 1×2 couplers, 2×2 couplers, or other types of couplers instead of the 1×3 coupler.

The downlink receiver 131 demodulates the downlink modulated signal to recover the downlink data 106. The downlink receiver 131 converts optical power to voltage for processing by filters, demodulators, and other circuitry. For example, electrical filters may be coupled after the downlink receiver 131 while optical filters may be coupled before the downlink receiver 131. In an embodiment, an optical amplifier, or other optical device, may be coupled prior to the downlink receiver 131. The receiver 131 comprises a photodiode, a photomultiplier tube, or a thermopile for detecting the light and converting to the voltage. The receiver may operate from 400 nm to 2500 nm, detect signals from 1 Hz to 100 GHz. and have sensitivity between 0 dBm and −80 dBm.

The uplink modulator 133 modulates the received downlink modulated light signal in response to uplink data 135 using a second protocol (e.g., second modulation scheme, data rate, frequency) to generate an uplink modulated light signal. The uplink modulated light signal is transmitted on the fiber channel 111 to the circulator 107 that transmits the signal to the uplink receiver 109 for processing (e.g., demodulating, filtering). In an embodiment, the uplink data 135 may include logging data from a wireline operation, a coiled tubing operation, or a logging-while-drilling/measurements-while-drilling operation as discussed subsequently.

For full-duplex operation of the system, asymmetric protocols (e.g., modulation, frequency, data rate, subcarrier) are asymmetric with respect to each other. In other words, the protocol used at the surface portion 100 of the system to transfer data to the downhole portion 150 of the system should be different than the protocol used at the downhole portion 150 to transfer data to the surface portion 100. For purposes of illustration only, examples of typical protocols used to transmit data may include MIL-STD-1553, MIL-STD-1773, Manchester encoding, On-Off Keying, pulse-amplitude modulation (PAM), IEEE 802, orthogonal frequency-division multiplexing (OFDM), quadrature amplitude modulation (QAM), and serial as well as others.

The protocols may also include different light frequencies or data rates for the downlink and uplink telemetry. For proper operation, the uplink and downlink signals should operate in separate and/or orthogonal frequency regimes. One method for choosing the uplink and downlink protocols for full-duplex operation is to examine the spectral response of the uplink and downlink signals and filter them (e.g., bandpass, lowpass, highpass, band-stop, low-band-pass, band-high-pass, low-band-high-pass, frequency division multiplexing, etc.) to recover the respective individual data. The recovered data from the uplink receiver 109 provides not only the uplink data 135 but also verifies the transmission of the downlink data 106.

FIG. 1 illustrates different modulation schemes as the different protocols. For example, the downlink data 106 and the downlink received data 134 are shown as PAM and the uplink data 135 is shown as QAM. Thus, the uplink received data 136 shows a QAM modulated PAM signal. These signals are shown in FIGS. 2-5 and are for purposes of illustration only to show one possible operation of the system. Other embodiments are not limited to any one set of different protocols.

Figure 2:
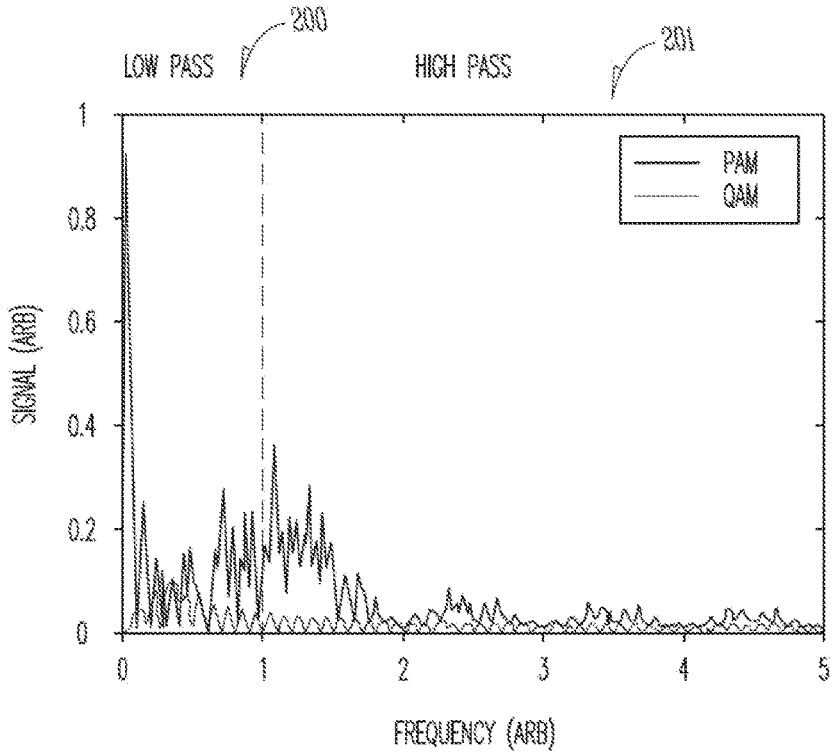
FIG. 2 is a plot showing spectral responses of two example signals encoded with different modulation schemes, according to various embodiments.

FIG. 2 is a plot showing spectral responses of two example signals encoded with different modulation schemes, according to various embodiments. For purposes of illustration, the signals are PAM and QAM signals. The x-axis is frequency with arbitrary units and the y-axis is signal amplitude also with arbitrary units.

Data transmitted on the downlink and the uplink, with proper selection of data rates and/or modulation schemes, can be extracted, transmitted, and recovered substantially simultaneously. FIG. 2 shows a PAM signal that may be extracted using a low pass filter 200 and a QAM signal that may be extracted using a high pass filter 201 since the two responses do not appreciably overlap.

Figure 3:
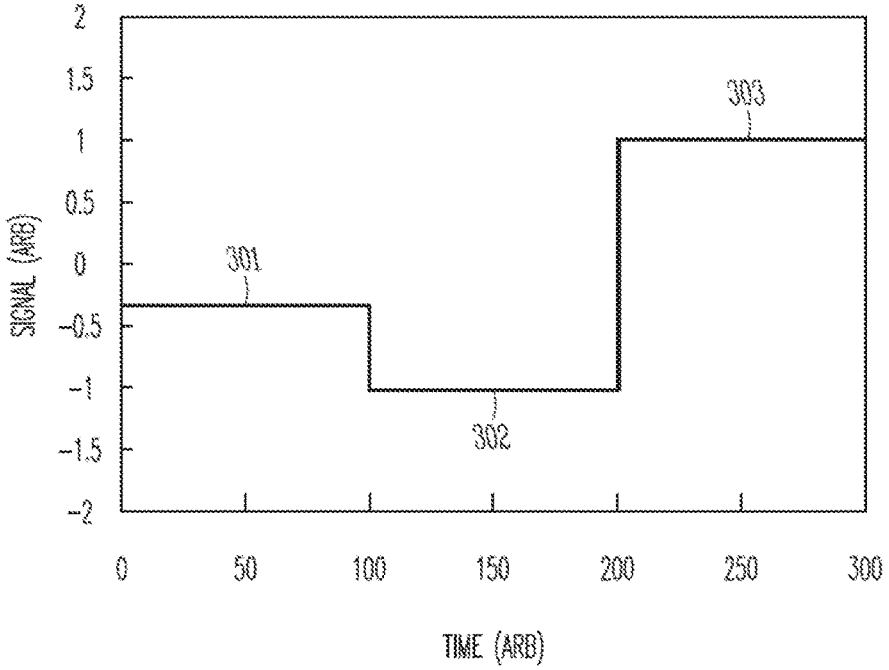
FIG. 3 is a plot showing a transmitted and downlink recovered pulse amplitude modulated signal, according to various embodiments.

FIG. 3 is a plot showing a transmitted and downlink recovered pulse amplitude modulated signal, according to various embodiments. The x-axis of this plot is time with arbitrary units and the y-axis is signal amplitude also with arbitrary units.

The plot shows three symbols 301-303 of a 4-PAM signal for downlink data that is used to modulate the downlink signal. This is also the plot of what is recovered by the downlink receiver 131 from the modulated downlink signal.

At substantially the same time, 30 symbols of a 4-QAM signal are modulated onto the downlink signal to become the uplink signal.

Figure 4:
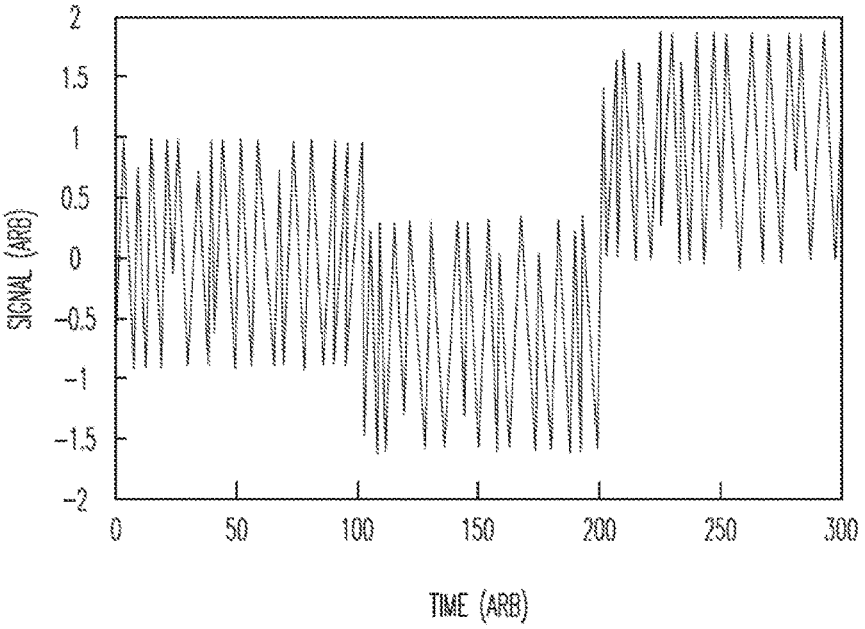
FIG. 4 is a plot showing an uplink modulated signal at the uplink receiver, according to various embodiments.

FIG. 4 is a plot showing an uplink modulated signal at the uplink receiver 109, according to various embodiments. The x-axis is time with arbitrary units and the y-axis is signal amplitude also with arbitrary units.

This figure shows the 30 symbols of the 4-QAM signal of FIG. 4 modulated onto the 3 symbols of the 4-PAM signal from the downlink modulator 105. This is the resulting modulated signal produced after the light passes through the uplink modulator 133 of the system of FIG. 1 as a result of both the downlink and uplink encoding of the example modulation schemes used in illustrated embodiment co-existing on the same signal.

Figure 5:
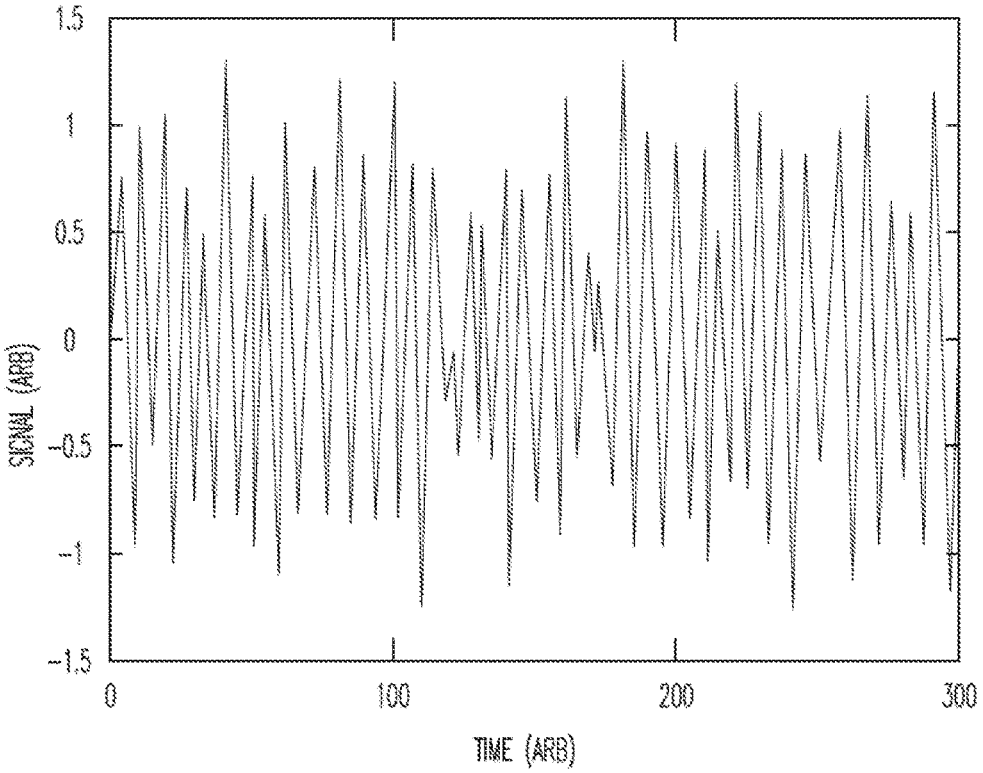
FIG. 5 is a plot showing a transmitted and uplink recovered quadrature amplitude modulated signal, according to various embodiments.

FIG. 5 is a plot showing a transmitted and uplink recovered quadrature amplitude modulated signal, according to various embodiments. The x-axis is time with arbitrary units and the y-axis is signal amplitude also with arbitrary units. This figure shows the 30 symbols of the 4-QAM signal.

In addition to the low-pass and high-pass filtering systems described above, more advanced frequency division methods may be used to incorporate greater amounts of data onto the full-duplex system. For example, downlink telemetry and uplink telemetry might be encoded on alternating subcarriers, such as shown in FIG. 6.

Figure 6:
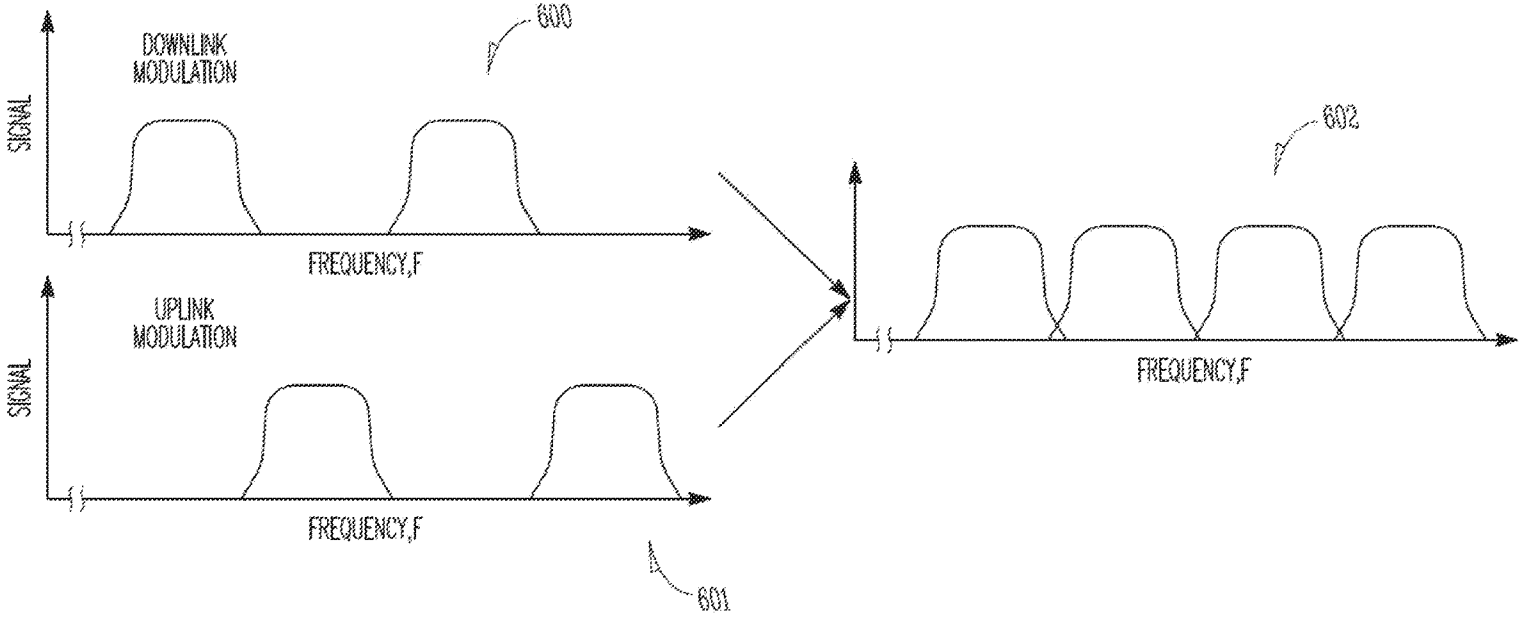
FIG. 6 is a plot showing alternating subcarrier encoding for downlink and uplink modulation, according to various embodiments.

FIG. 6 is a plot showing alternating subcarrier encoding for downlink 600 and uplink modulation 601, according to various embodiments. The x-axis of these plots is frequency with arbitrary units while the y-axis is signal amplitude with arbitrary units.

This figure shows an example of both downlink 600 and uplink 601 telemetry using schemes without interfering with each other. Thus, the resulting uplink modulated signal 602 could include both downlink 600 and uplink 601 telemetry data.

By spreading the telemetry data over multiple subcarriers, the data itself may be more robust to burst noise, fading, and/or changes to thermally-dependent noise profiles.

Figure 7:
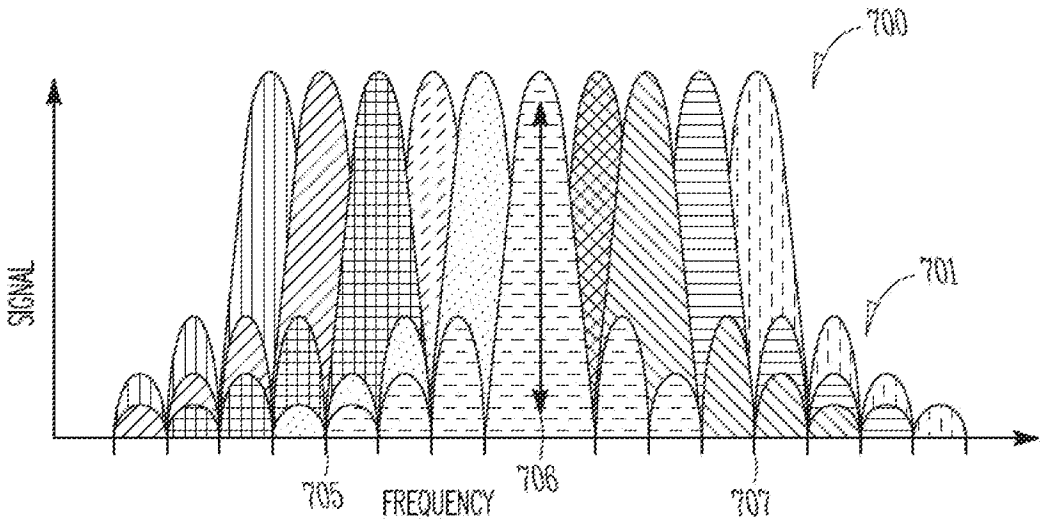
FIG. 7 is a plot showing orthogonal frequency division multiplexing using a dense orthogonal basis set of subcarriers, according to various embodiments.

FIG. 7 is a plot showing orthogonal frequency division multiplexing (OFDM) using a dense orthogonal basis set of subcarriers, according to various embodiments. The x-axis of these plots is frequency with arbitrary units while the y-axis is signal amplitude with arbitrary units.

The modulation scheme of FIG. 7 may allow even higher levels of data transmission as modulation spectra are chosen such that the signals may overlap but are orthogonal to each other so that they do not interfere. Each signal is then independent of the other and may be demodulated using the proper basis set. For both types of modulation schemes, smaller bandwidths (and hence less expensive) may be used to demodulate signals that are spread over a wide frequency range.

FIG. 7 shows the overlapping subcarriers 700 with their sinc function side lobes 701. It may be noted that the subcarrier nulls 705-707 correspond to peaks of adjacent subcarriers for zero inter-carrier interference.

A single source full-duplex optical communication system may also use phase modulation instead of amplitude modulation, as discussed previously. Such a system may be built with (FIG. 8) or without (FIG. 9) signal frequency selection. Modulating the optical phase, as opposed to the optical amplitude, mitigates the effects of vibration, rotation, and polarization drift since these effects only weakly interact with the optical phase. Furthermore, since optical phase modulation generally has an improved signal-to-noise as compared to amplitude modulation, higher data rates may be encoded into the system. Finally, by using two fibers with downlink and uplink telemetries sharing both fibers but going in opposite directions, the deleterious effect on signal due to coherent feedback may be eliminated.

Two such example systems are now discussed. Both systems transmit data in a full duplex protocol by separating a highly coherent light source into several streams.

Figure 8:
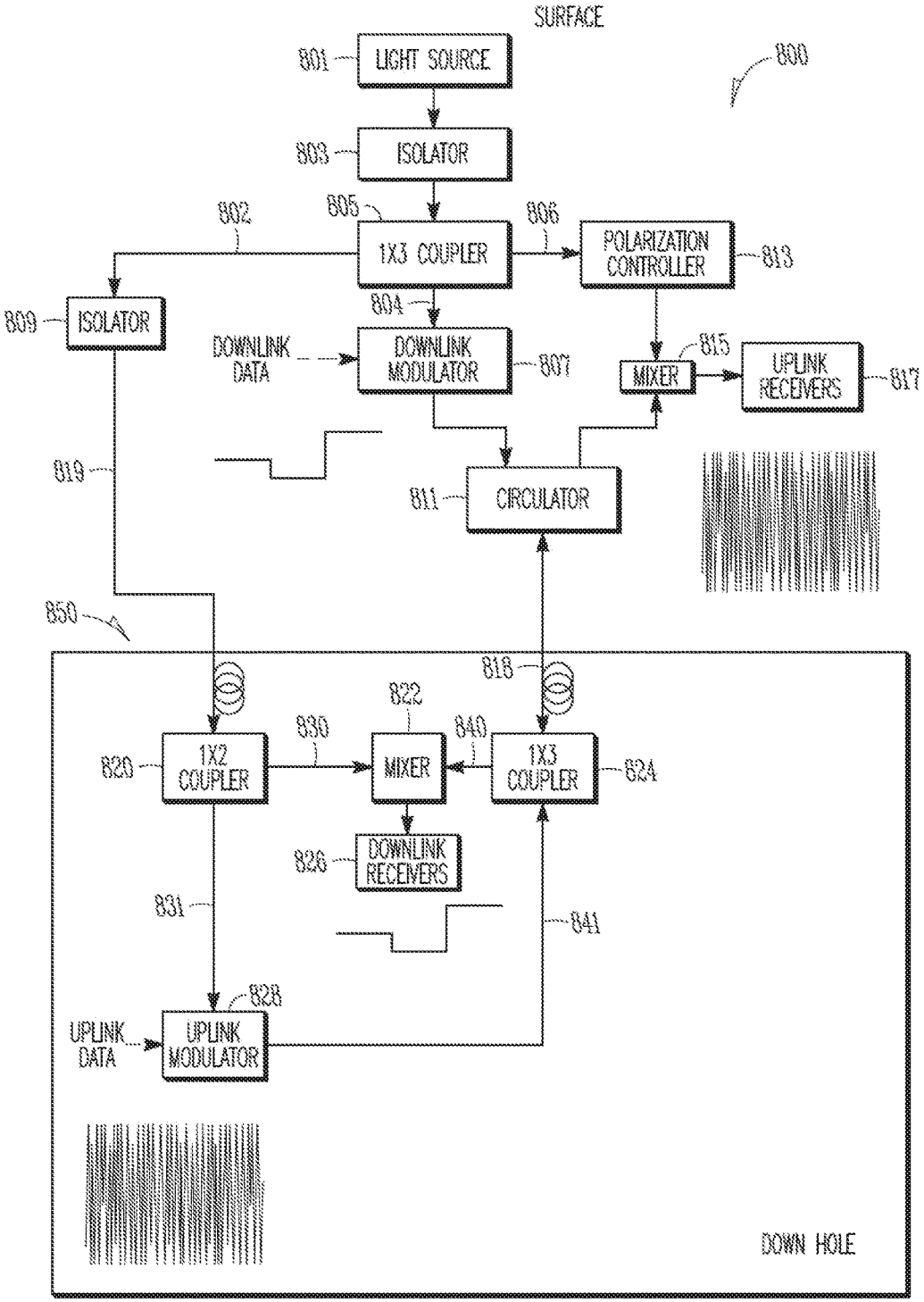
FIG. 8 is a block diagram showing another embodiment of a single light source full-duplex fiber optic communication system, according to various embodiments.

FIG. 8 is a block diagram showing another embodiment of a single light source full-duplex fiber optic communication system, according to various embodiments. The block diagram is for illustration purposes only since different components having a substantially similar function may be substituted for the illustrated components.

The system may be broken up into an uphole (i.e., surface) portion 800 and a downhole (i.e., borehole) portion 850. While certain components are shown in either the surface 800 or the downhole 850 portions, the system embodiments are not restricted to any such implementation. For example, the single light source 801 may be located either downhole 850 or on the surface 800.

The surface portion 800 comprises the single light source 801. The light source 801 (e.g., lasers, light emitting diode (LED), amplified spontaneous emission (ASE)) generates a light signal for transmission through the system. Only the single light source 801 is used and is constantly transmitting the light signal. The light source 800 operates at wavelengths between 800 nanometers (nm) and 1700 nm and operates with coherence lengths between 1 micrometer (μm) and 2000 kilometers (km).

An optical isolator 803 is coupled to the light source 801. The optical isolator 803 ensures that light travels in only one direction. While the isolator 803 may reduce the signal strength, the isolator also reduces intersymbol interference of uplink data at high data rates. In an embodiment, optical filters, optical attenuators, and/or optical amplifiers may also be added after the light source 801.

A downlink coupler 805 (e.g., 1×3 coupler) is coupled to the optical isolator 803. The coupler 805 splits the light signal from the isolator 803 into three light signals 802, 804, 806.

A first light signal 802 provides light for the uplink modulator 828 and serves as the local oscillator reference for the downlink mixer 822. This light signal starts at the surface, goes through an optical isolator 809, is modulated downhole, returns to the surface to be mixed with a second light signal 806 that serves as the local oscillator for the surface mixer 815 and finally is detected by the uplink receivers 817. A third light signal 804 is the downlink telemetry in which the downlink data is encoded onto the optical phase at the surface, passes downhole over the fiber optic channel 818, and is mixed with a local oscillator at the downlink mixer 822 to finally be detected by the downlink receivers 826.

A polarization controller 813 is coupled to the coupler 805 with the second light signal 806 as an input. The polarization controller 813 is configured to adjust a polarization of the light signal 806 to generate a polarized light signal for optimal use in the system. The polarization controller 813 may adjust the light signal polarization manually or by electrical control signals, with or without automatic feedback. For example, feedback of fiber strain, compression, torsion, and/or temperature may be used by the polarization controller 813 to adjust the light polarization. The polarization controller 813 may transform a fixed, known polarization into an arbitrary one or vice versa.

A downlink modulator 807 is coupled to the coupler 805 with the third light signal 804 as an input. The downlink modulator 807 modulates the light signal in response to downlink data, using a first protocol, to generate a downlink modulated light signal for transmission downhole over the fiber optic channel 818. The modulator 807 includes an electro-optic modulator, an electro-absorption modulator, a semiconductor optical amplifier, an optical switch, and/or a fiber attenuator to perform the modulation. The modulator 807 operates from 400 nm to 2500 nm; modulates from 1 Hz to 100 GHz, and maintains polarization or is polarization insensitive. In an embodiment, the downlink data may include commands to be transmitted to a tool downhole.

A circulator 811 is coupled to the downlink modulator 807. The circulator 811 directs light from the modulator 807 to the fiber optic channel 818 and from the fiber optic channel 818 into the uplink receivers 817. For example, the circulator 811 couples the downlink modulated light signal to a downhole coupler 824 and an uplink modulated signal to the uplink receivers 817. The circulator 811 may be any commercially available circulator centered at the wavelength of operation.

The uplink mixer 815 is coupled to the polarization controller 813 and the circulator 811. As discussed previously, the uplink mixer 815 provides a mixed light signal to the uplink receivers 817 having a signal that is a mix of the uplink signal from the downhole portion 850 and the polarized light signal used as the reference oscillator signal.

The uplink receivers 817, coupled to the uplink mixer 815, converts optical power to voltages for processing by other circuitry (e.g., filters, demodulators). In an embodiment, optical filters and/or optical amplifiers may be coupled prior to the uplink receivers 817. The uplink receivers 817 includes filters and demodulators for recovering both the downlink data and the uplink data. The receivers 817 include a photodiode, a photomultiplier tube or a thermopile for detecting the received light and converting to the associated voltages based on the detected amplitude. The receivers 817 may operate from 400 nm to 2500 nm, detect signals from 1 Hz to 100 GHz, and have sensitivity between 0 dBm and −80 dBm. The receivers 817 may be cooled using Peltier coolers or cryocoolers.

The optical fiber channels 818, 819 may be pure silica or doped with erbium, ytterbium, neodymium, boron, or some other dopant. The fiber channels 818, 819 may be single mode, multimode, or polarization maintaining. The fiber channels 818, 819 may be jacketed with polyimide, silicone-PFA, or carbon composite and be part of a larger composite cable that can include electrically conducting lines, other optical fibers, or structural support. The electrically conducting lines may be in a separate cable in another embodiment.

The downhole portion 850 is coupled to the surface portion 800 through the fiber optic channels 818, 819. The downhole portion 850 includes a first optical coupler 820 (e.g., 1×2) to split the reference oscillator light signal, a second optical coupler 824 (e.g., 1×2) to split the uplink modulated signal, the downlink receivers 826, and the uplink modulator 828.

The first optical coupler 820 is coupled to the fiber channel 819 to split the reference oscillator light signal from the downlink coupler 805 into two channels 830, 831. The first channel 830 is used as a reference oscillator signal for the downlink mixer 822. The second channel 831 is used as a reference oscillator for the uplink modulator 828.

The second optical coupler 824 is coupled to the fiber channel 818 to split the uplink modulated signal 841 into two channels 840, 818. The first channel 840 couples the uplink modulated signal to the downlink mixer 822 to be mixed with the reference oscillator signal 830 with the new signal being coupled to the downlink receivers 826. The second channel 818 from the coupler 824 is the fiber channel 818 between the surface 800 and downhole 850 portions.

The downlink receivers 826 demodulate the downlink modulated signal to recover the downlink data. The downlink receivers 826 convert optical power to voltage for processing by filters, demodulators, and other circuitry that are part of the receivers 826. The receivers 826 comprise a photodiode, a photomultiplier tube or a thermopile for detecting the light and converting to the voltage. The receivers 826 may operate from 400 nm to 2500 nm, detect signals from 1 Hz to 100 GHz. and have sensitivity between 0 dBm and −80 dBm. For example, electrical filters may be coupled after the downlink receivers 826 while optical filters may be coupled before the downlink receivers 826. In an embodiment, an optical amplifier, or other optical device, may be coupled prior to the downlink receivers 826.

The uplink modulator 828 modulates the received downlink modulated light signal in response to uplink data and the reference oscillator signal from the surface using a second protocol (e.g., second modulation scheme, data rate, frequency) to generate an uplink modulated light signal. The uplink modulated light signal is transmitted on the fiber channel 818 to the circulator 811 that transmits the signal to the uplink receivers 817 for processing (e.g., demodulating, filtering). In an embodiment, the uplink data may include logging data from a wireline operation, a production tubing operation, or a logging-while-drilling/measurements-while-drilling operation as discussed subsequently.

Figure 9:
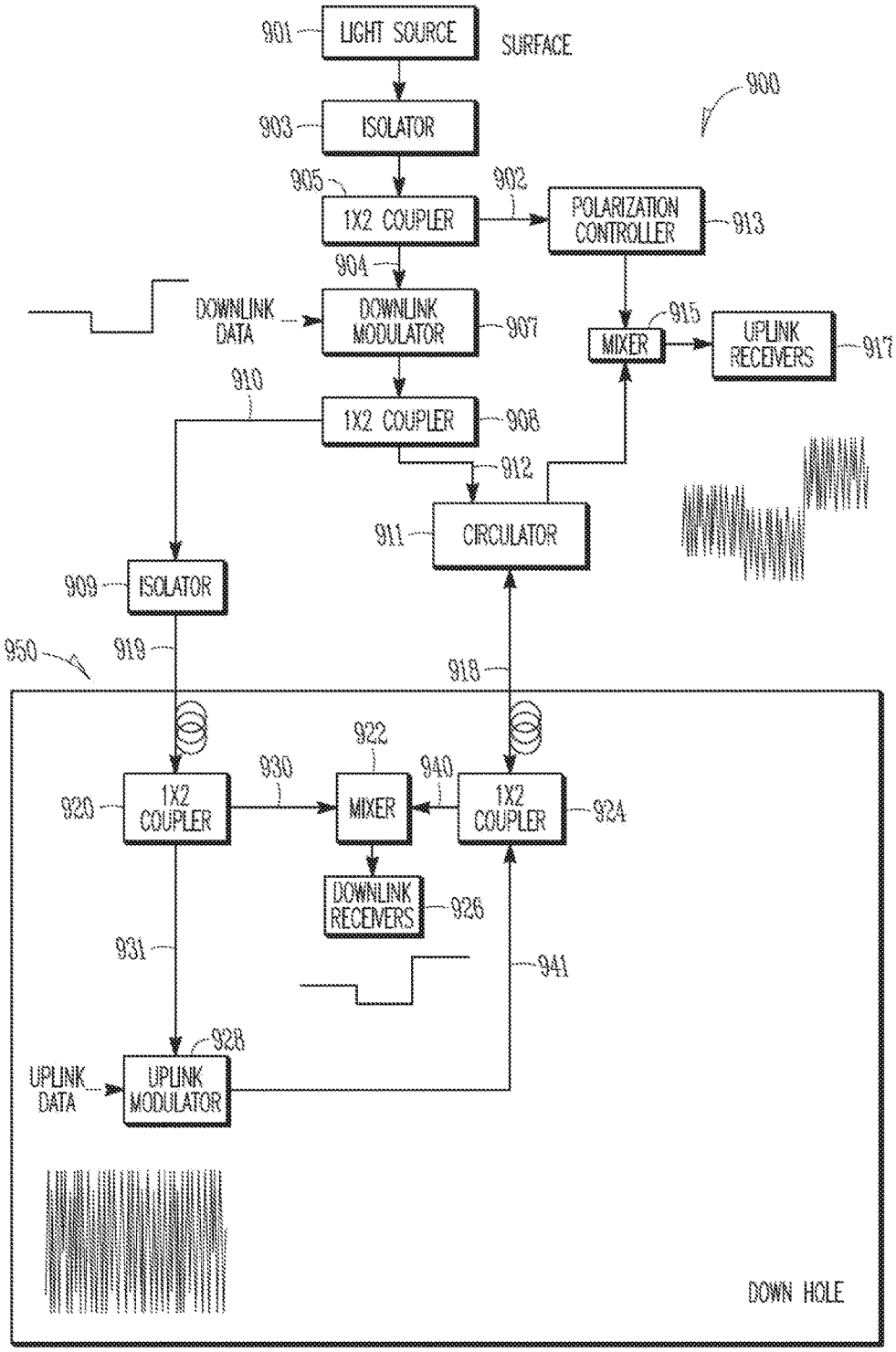
FIG. 9 is a block diagram showing yet another embodiment of a single light source full-duplex fiber optic communication system, according to various embodiments.

FIG. 9 is a block diagram showing yet another embodiment of a single light source full-duplex fiber optic communication system, according to various embodiments. The block diagram is for illustration purposes only since different components having a substantially similar function may be substituted for the illustrated components.

The system may be broken up into an uphole (i.e., surface) portion 900 and a downhole (i.e., borehole) portion 950. While certain components are shown in either the surface 900 or the downhole 950 portions, the system embodiments are not restricted to any such implementation. For example, the single light source 901 may be located either downhole 950 or on the surface 900.

The surface portion 900 comprises the single light source 901. The light source 901 (e.g., lasers, light emitting diode (LED), amplified spontaneous emission (ASE)) generates a light signal for transmission through the system. Only the single light source 901 is used and is constantly transmitting the light signal. The light source 900 operates at wavelengths between 800 nanometers (nm) and 1700 nm and operates with coherence lengths between 1 micrometer (μm) and 2000 kilometers (km).

An optical isolator 903 is coupled to the light source 901. The optical isolator 903. The isolator 903 ensures that light travels in only one direction. While the isolator 903 may reduce the signal strength, the isolator also reduces intersymbol interference of uplink data at high data rates. In an embodiment, optical filters, optical attenuators, and/or optical amplifiers may be added after the light source 901.

A first downlink optical coupler 905 (e.g., 1×2 coupler) is coupled to the optical isolator 903. The coupler 905 splits the light signal from the isolator 903 into two light signals 902, 904.

A first light signal 904 is used for the downlink telemetry in which the downlink data is encoded onto the optical phase at the surface, passes downhole over the fiber optic channel 918, and is mixed with a local oscillator at the downlink mixer 922 to finally be detected by the downlink receivers 926. The second light signal 902 is coupled to a polarization controller 913 to be used as a reference oscillator signal for the uplink mixer 915.

The polarization controller 913 is coupled to the coupler 905 with the second light signal 902 as an input. The polarization controller 913 is configured to adjust a polarization of the light signal 902 to generate a polarized light signal for optimal use in the system. The polarization controller 913 may adjust the light signal polarization manually or by electrical control signals, with or without automatic feedback. For example, feedback of fiber strain, compression, torsion, and/or temperature may be used by the polarization controller 913 to adjust the light polarization. The polarization controller 913 may transform a fixed, known polarization into an arbitrary one or vice versa.

A downlink modulator 907 is coupled to the first downlink coupler 905 with the first light signal 904 as an input. The downlink modulator 907 modulates the light signal in response to downlink data, using a first protocol, to generate a downlink modulated light signal for transmission downhole over the fiber optic channel 918. The modulator 907 includes an electro-optic modulator, an electro-absorption modulator, a semiconductor optical amplifier, an optical switch, and/or a fiber attenuator to perform the modulation. The modulator 907 operates from 400 nm to 2500 nm; modulates from 1 Hz to 100 GHz, and maintains polarization or is polarization insensitive. In an embodiment, the downlink data may include commands to be transmitted to a tool downhole.

A second downlink optical coupler 908 (e.g., 1×2) is coupled to the downlink demodulator 907. The second downlink coupler 908 splits the modulated downlink signal into two channels 910, 912. A first light signal 910 provides light for the uplink modulator 928 and serves as the local oscillator reference for the downlink mixer 922. This light signal starts at the surface, goes through an optical isolator 909, is modulated downhole, returns to the surface to be mixed with a second light signal 902 that serves as the local oscillator for the surface mixer 915 and finally is detected by the uplink receivers 917.

A circulator 911 is coupled to the second channel 912 of the second downlink coupler 908. The circulator 911 directs light from the modulator 907 to the fiber optic channel 918 and from the fiber optic channel 918 into the uplink receivers 917. For example, the circulator 911 couples the downlink modulated light signal to a first downhole coupler 924 and an uplink modulated signal to the uplink receivers 917. The circulator 911 may be any commercially available circulator centered at the wavelength of operation.

The uplink mixer 915 is coupled to the polarization controller 913 and the circulator 911. As discussed previously, the uplink mixer 915 provides a mixed light signal to the uplink receivers 917 having a signal that is a mix of the uplink signal from the downhole portion 950 and the polarized light signal used as the reference oscillator signal.

The uplink receivers 917, coupled to the uplink mixer 915, converts optical power to voltages for processing by other circuitry (e.g., filters, demodulators, amplifiers). The uplink receivers 917 include filters and demodulators for recovering both the downlink data and the uplink data. For example, electrical filters may be coupled after the uplink receivers 917 while optical filters may be couple before the uplink receivers 917. In an embodiment, an optical amplifier, or other optical device, may be coupled prior to the uplink receivers 917. The receivers 917 include a photodiode, a photomultiplier tube or a thermopile for detecting the received light and converting to the associated voltages based on the detected amplitude. The receivers 917 may operate from 400 nm to 2500 nm, detect signals from 1 Hz to 100 GHz, and have sensitivity between 0 dBm and −80 dBm. The receivers 917 may be cooled using Peltier coolers or cryocoolers.

The optical fiber channels 918, 919 may be pure silica or doped with erbium, ytterbium, neodymium, boron, or some other dopant. The fiber channels 918, 919 may be single mode, multimode, or polarization maintaining. The fiber channels 918, 919 may be jacketed with polyimide, silicone-PFA, or carbon composite and be part of a larger composite cable that can include electrically conducting lines, other optical fibers, or structural support. The electrically conducting lines may be in a separate cable in another embodiment.

The downhole portion 950 is coupled to the surface portion 900 through the fiber optic channels 918, 919. The downhole portion 950 includes a first uplink optical coupler 920 (e.g., 1×2) to split the reference oscillator light signal, a second uplink optical coupler 924 (e.g., 1×2) to split the uplink modulated signal, the downlink receivers 926, and the uplink modulator 928.

The first optical coupler 920 is coupled to the fiber channel 919 to split the reference oscillator light signal from the downlink coupler 905 into two channels 930, 931. The first channel 930 is used as a reference oscillator signal for the downlink mixer 922. The second channel 931 is used as a reference oscillator for the uplink modulator 928.

The second optical coupler 924 is coupled to the fiber channel 918 to split the uplink modulated signal 941 into two channels 940, 918. The first channel 840 couples the uplink modulated signal to the downlink mixer 922 to be mixed with the reference oscillator signal 930 with the new signal being coupled to the downhole receivers 926. The second channel 918 from the second optical coupler 924 is the fiber channel 918 between the surface 900 and downhole 950 portions.

The downlink receivers 926 demodulate the downlink modulated signal to recover the downlink data. The downlink receivers 926 convert optical power to voltage for processing by filters, demodulators, amplifier, and other circuitry that are part of the receivers 926. For example, electrical filters may be coupled after the downlink receivers 926 while optical filters may be coupled before the downlink receivers 926. In an embodiment, an optical amplifier, or other optical device, may be coupled prior to the downlink receivers 926. The receivers 926 comprise a photodiode, a photomultiplier tube or a thermopile for detecting the light and converting to the voltage. The receivers 926 may operate from 400 nm to 2500 nm, detect signals from 1 Hz to 100 GHz. and have sensitivity between 0 dBm and −80 dBm.

The uplink modulator 928 modulates the received downlink modulated light signal in response to uplink data and the reference oscillator signal from the surface using a second protocol (e.g., second modulation scheme, data rate, frequency) to generate an uplink modulated light signal. The uplink modulated light signal is transmitted on the fiber channel 918 to the circulator 911 that transmits the signal to the uplink receivers 917 for processing (e.g., demodulating, filtering). In an embodiment, the uplink data may include logging data from a wireline operation, production tubing operation, or a logging-while-drilling/measurements-while-drilling operation as discussed subsequently.

Figure 10:
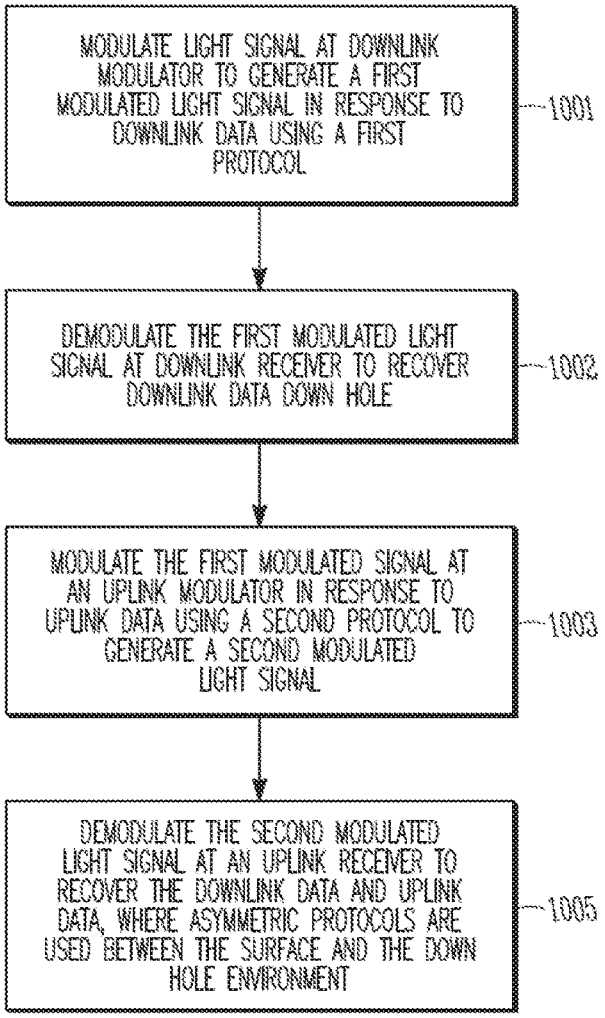
FIG. 10 is a flowchart of a method for single source, full-duplex communication, according to various embodiments.

FIG. 10 is a flowchart of a method for single source, full-duplex communication, according to various embodiments. In block 1001, a light signal is modulated at a downlink modulator to generate a first modulated light signal in response to downlink data using a first protocol (e.g., modulation scheme, data rate, subcarrier, frequency). In block 1002, the first modulated light signal is demodulated at the downlink receiver to recover the downlink data in the downhole environment. In block 1003, the first modulated light signal is modulated at an uplink modulator in response to uplink data using a second protocol (e.g., modulation scheme, data rate, subcarrier, frequency) to generate a second modulated light signal. In block 1005, the second modulated light signal is demodulated at an uplink receiver to recover the downlink data and the uplink data. In this method, the first protocol is asymmetric with respect to the second protocol. In other words, asymmetric protocols are used between the surface and the downhole environment. For example, at least one of a downlink data rate is different from an uplink data rate, the first modulation scheme is different from the second modulation scheme, a different frequency is used between downhole and the surface, or different subcarriers are used between the surface and downhole.

Figure 11:
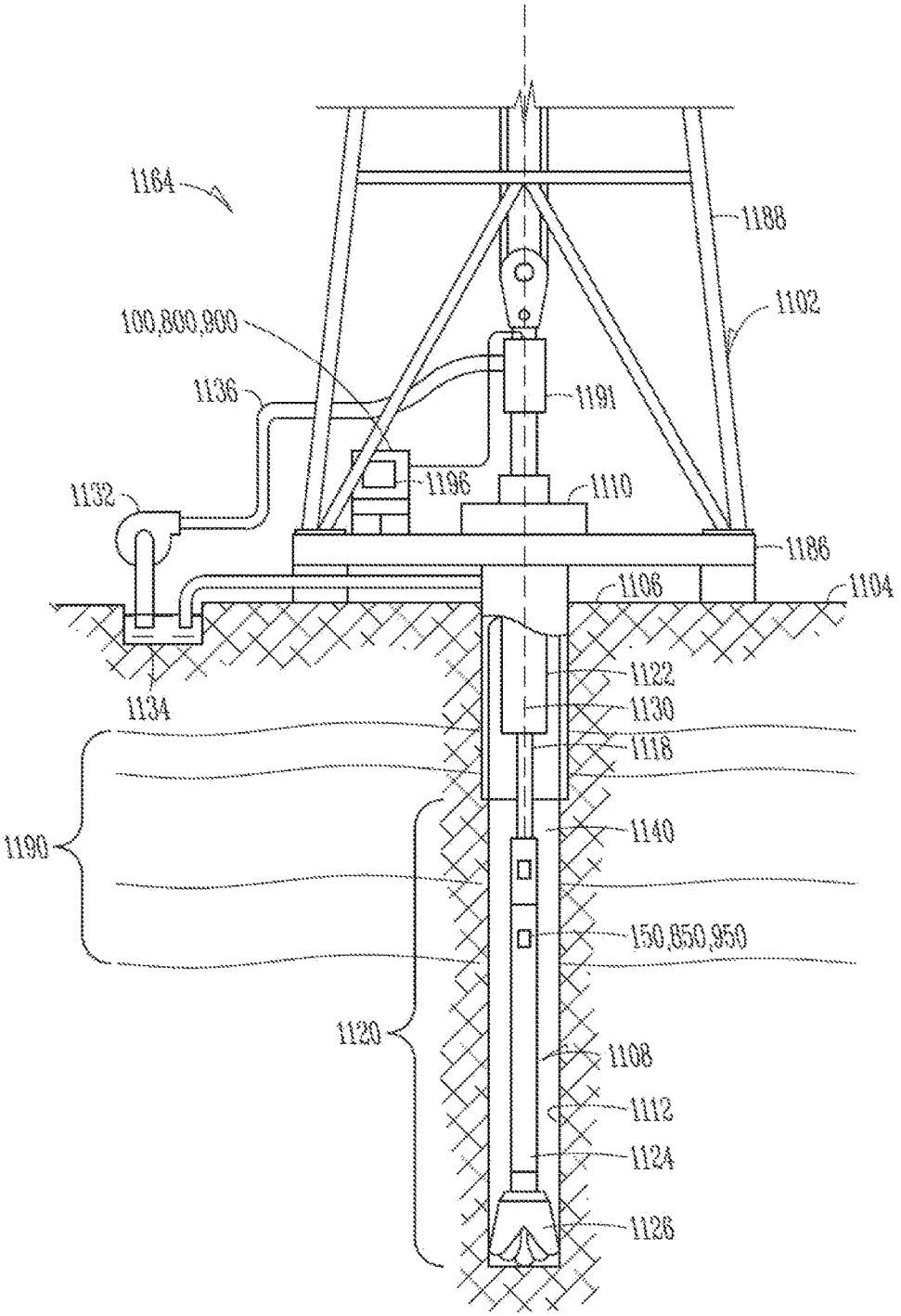
FIG. 11 is a diagram showing a drilling system, according to various embodiments.

FIG. 11 is a diagram showing a drilling system 1164, according to various embodiments. The system 1164 includes a drilling rig 1102 located at the surface 1104 of a well 1106. The drilling rig 1102 may provide support for a drillstring 1108. The drillstring 1108 may operate to penetrate the rotary table 1110 for drilling the borehole 1112 through the subsurface formations 1190. The drillstring 1108 may include a drill pipe 1118 and the bottom hole assembly (BHA) 1120 (e.g., drill string), perhaps located at the lower portion of the drill pipe 1118.

The BHA 1120 may include drill collars 1122, a downhole tool 1124, stabilizers, sensors, an RSS, a drill bit 1126, as well as other possible components. The drill bit 1126 may operate to create the borehole 1112 by penetrating the surface 1104 and the subsurface formations 1190.

The BHA 1120 may further include the downhole portions 150, 850, 950 of the above-described systems as part of the downhole tool 1124. Cable 1130 may incorporate all of the fiber optic cables of those embodiments such as fiber optic cables 111, 818, 819, 918, 919. The downhole portions 150, 850, 950 may be used for fiber optic telemetry of measurement data from the downhole tool 1124 during logging-while-drilling/measurement-while-drilling (LWD/MWD) operations.

During drilling operations within the borehole 1112, the drillstring 1108 (perhaps including the drill pipe 1118 and the BHA 1120) may be rotated by the rotary table 1110. Although not shown, in addition to or alternatively, the BHA 1120 may also be rotated by a motor (e.g., a mud motor) that is located downhole. The drill collars 1122 may be used to add weight to the drill bit 1126. The drill collars 1122 may also operate to stiffen the BHA 1120, allowing the BHA 1120 to transfer the added weight to the drill bit 1126, and in turn, to assist the drill bit 1126 in penetrating the surface 1104 and subsurface formations 1190.

During drilling operations, a mud pump 1132 may pump drilling fluid (sometimes known by those of ordinary skill in the art as "drilling mud") from a mud pit 1134 through a hose 1136 into the drill pipe 1118 and down to the drill bit 1126. The drilling fluid can flow out from the drill bit 1126 and be returned to the surface 1104 through an annular area 1140 between the drill pipe 1118 and the sides of the borehole 1112. The drilling fluid may then be returned to the mud pit 1134, where such fluid is filtered. In some examples, the drilling fluid can be used to cool the drill bit 1126, as well as to provide lubrication for the drill bit 1126 during drilling operations. Additionally, the drilling fluid may be used to remove subsurface formation cuttings created by operating the drill bit 1126.

Surface portions 100, 800, 900 of the above-described systems including a controller 1196 may include modules comprising hardware circuitry, a processor, and/or memory circuits that may store software program modules and objects, and/or firmware, and combinations thereof that are configured to execute at least the method of FIG. 10. The surface portions 100, 800, 900 may also include modulators and demodulators (including optical receivers, transmitters, transceivers, and other optical equipment known to a user versed in the art) for modulating and demodulating data transmitted downhole through the fiber optic cable 1130 or telemetry received through the fiber optic cable 1130 from the downhole environment. The surface portions 100, 800, 900 and controller 1196 are shown near the rig 1102 only for purposes of illustration as these components may be located at remote locations.

An optical rotary joint 1191 may be located between the fiber in the drill string 1108 and that on the surface. In another embodiment, the optical signals may be converted to electrical signals at the top of the drill string 1108 and the signal transferred to surface processing systems or modulators/demodulators using an electrical slip ring in place of the optical rotary joint 1191. Similarly, electrical signals can be sent to the top of the drill string 1108 through the electrical slip ring and those signals could drive lasers that rotate with the drill string 1108.

These implementations can include a machine-readable storage device having machine-executable instructions, such as a computer-readable storage device having computer-executable instructions. Further, a computer-readable storage device may be a physical device that stores data represented by a physical structure within the device. Such a physical device is a non-transitory device. Examples of a non-transitory computer-readable storage medium can include, but not be limited to, read only memory (ROM), random access memory (RAM), a magnetic disk storage device, an optical storage device, a flash memory, and other electronic, magnetic, and/or optical memory devices.

Figure 12:
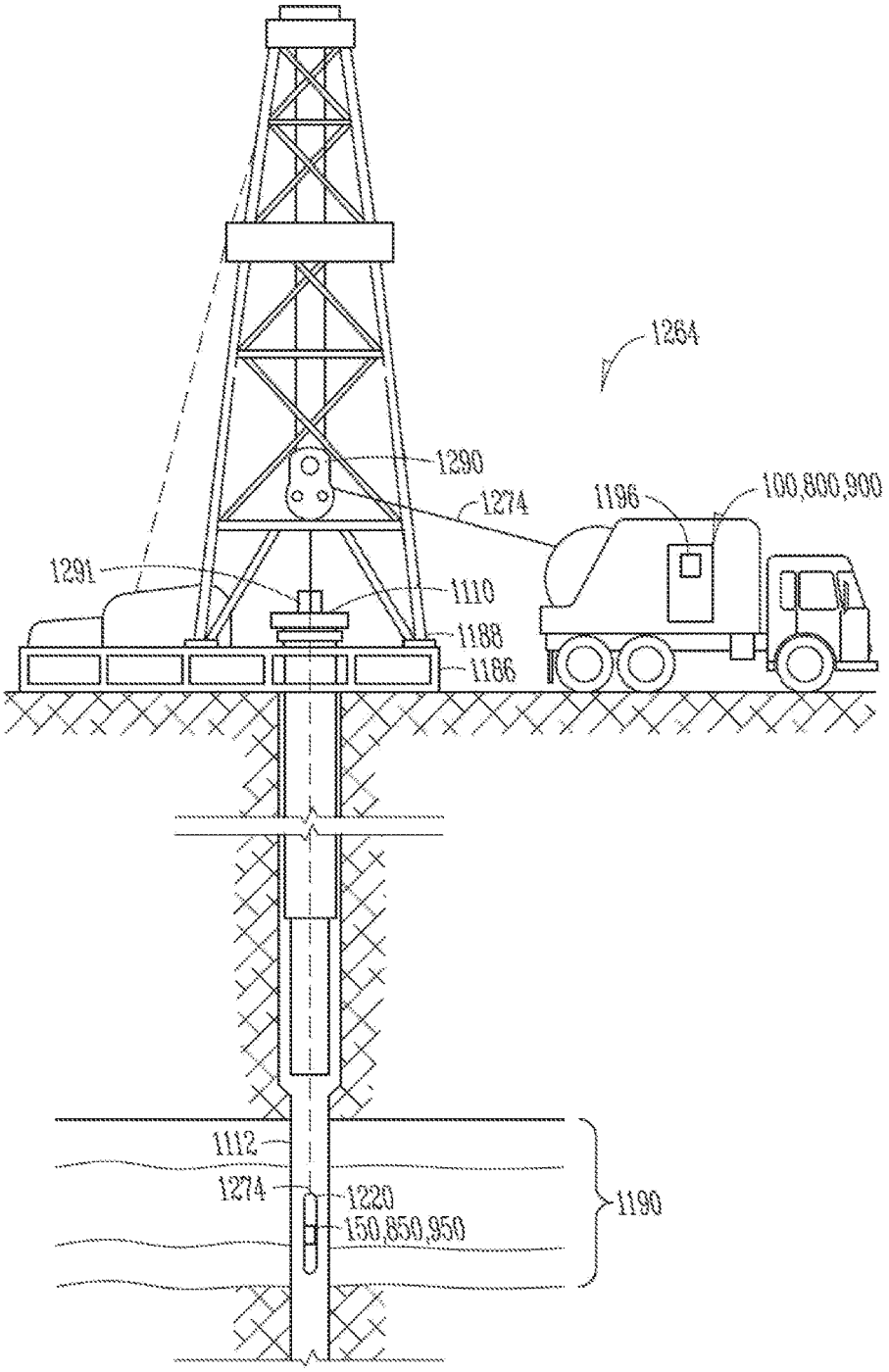
FIG. 12 is a diagram showing a wireline system, according to various embodiments.

FIG. 12 is a diagram showing a wireline system 1264, according to various examples of the disclosure. The system 1264 may comprise a wireline logging tool body 1220, as part of a wireline logging operation in a cased and cemented borehole 1112, that includes the downhole portions 150, 850, 950 as described previously.

A drilling platform 1186 equipped with a derrick 1188 that supports a hoist 1290 can be seen. Drilling oil and gas wells is commonly carried out using a string of drill pipes connected together so as to form a drillstring that is lowered through a rotary table 1110 into the cased borehole 1112. Here it is assumed that the drillstring has been temporarily removed from the borehole 1112 to allow the wireline tool 1220 that includes the downhole portions 150, 850, 950 to be lowered by wireline or logging cable 1274 (e.g., slickline cable) into the borehole 1112. Typically, the wireline logging tool body 1220 is lowered to the bottom of the region of interest and subsequently pulled upward at a substantially constant speed. The wireline or logging cable 1274 may include the fiber optic cables 111, 818, 819, 918, 919 as described previously.

During the upward trip, at a series of depths, various instruments may be used to perform measurements on the formation 1190. The wireline data may be communicated to a surface logging facility (e.g., surface portions 100, 800, 900) for processing, analysis, and/or storage using the above-described embodiments for the downhole portions 150, 850, 950 and the telemetry method of FIG. 10.

An optical rotary joint 1291 may be located between a fiber wireline or logging cable 1274 that is downhole and that on the surface. In another embodiment, the optical signals may be converted to electrical signals at the surface and the signal transferred to surface processing systems or modulators/demodulators using an electrical slip ring in place of the optical rotary joint 1291.

Figure 13:
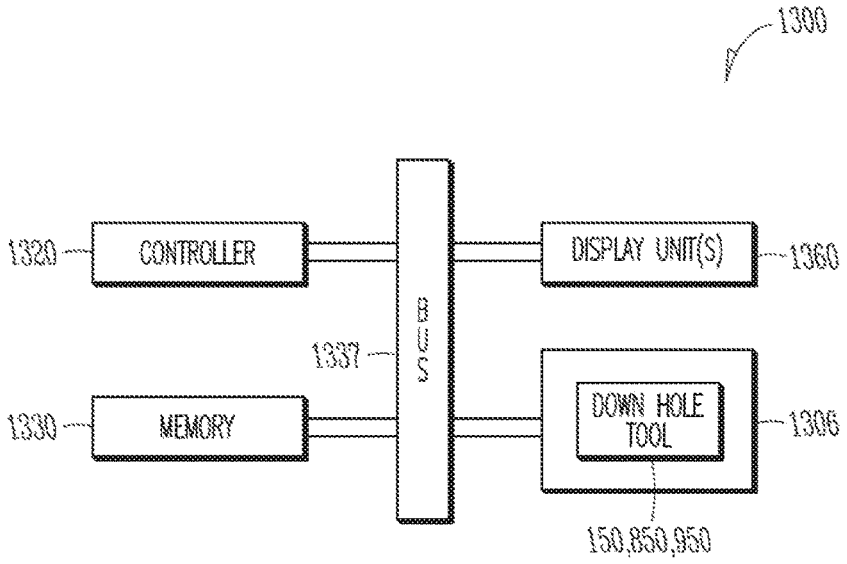
FIG. 13 is a block diagram of an example system operable to implement disclosed methods, according to various embodiments.

FIG. 13 is a block diagram of an example system 1300 operable to implement the activities of disclosed methods, according to various examples of the disclosure. The system 1300 may include a tool housing 1306 having the downhole portions 150, 850, 950 such as that illustrated in FIGS. 1, 8, and 9. The system 1300 may be configured to operate in accordance with the teachings herein to perform telemetry from the downhole portions 150, 850, 950. The system 1300 of FIG. 13 may be implemented as shown in FIGS. 11 and 12 with reference to the surface portions 100, 800, 900 and controller 1196.

The system 1300 may include a controller 1320, a memory 1330, and a communications unit 1335. The controller 1320, the memory 1330, and the communications unit 1335 may be arranged to operate as a control circuit to control operation of the downhole portions 150, 850, 950 and execute any methods disclosed herein.

The system 1300 may also include a bus 1337, where the bus 1337 provides electrical conductivity among the components of the system 1300. The bus 1337 can include an address bus, a data bus, and a control bus, each independently configured or in an integrated format. The bus 1337 may be realized using a number of different communication mediums that allows for the distribution of components of the system 1300. The bus 1337 may include a network. Use of the bus 1337 may be regulated by the controller 1320.

The system 1300 may include display unit(s) 1360 as a distributed component on the surface of a wellbore, which may be used with instructions stored in the memory 1330 to implement a user interface to monitor the operation of the downhole portions 150, 850, 950 or components distributed within the system 1300. Such a user interface may be operated in conjunction with the communications unit 1335 and the bus 1337. Many examples may thus be realized. A few examples of such examples will now be described.

While the above embodiments discuss using a downhole tool for the fiber optic telemetry, other embodiments may use the fiber optic telemetry in other fields of communications such as aerospace, subsea, and long-haul and data center communications.

Example 1 is a full-duplex borehole communication system comprising: a light source to generate a light signal; a downlink modulator coupled to the light source to modulate the light signal in response to downlink data using a first protocol to generate a first modulated light signal; an uplink modulator coupled to the downhole modulator to modulate the first modulated light signal in response to uplink data using a second protocol to generate a second modulated light signal; a downlink receiver coupled to the downlink modulator to demodulate the first modulated signal to recover the downlink data; and an uplink receiver coupled to the uplink modulator and configured to demodulate the second modulated light signal to recover the downlink data and the uplink data, wherein the first protocol is asymmetric with respect to the second protocol.

In Example 2, the subject matter of Example 1 can further include wherein the light source is located at one of either a downlink location or a formation surface location.

In Example 3, the subject matter of Examples 1-2 can further include a circulator coupled to the downlink modulator and the uplink receiver; and a coupler coupled between the circulator and the downlink receiver and between the circulator and the uplink modulator; wherein, the circulator is configured to couple the first modulated light signal to the coupler and the second modulated signal to the uplink receiver.

In Example 4, the subject matter of Examples 1-3 can further include wherein the uplink receiver comprises: a filter to separate the first modulated light signal from the second modulated light signal; and a plurality of demodulators to recover the downlink data and the uplink data from the first modulated light signal and the second modulator light signal, respectively.

In Example 5, the subject matter of Examples 1-4 can further include wherein the first and second protocols modulate an optical amplitude of the light signal.

In Example 6, the subject matter of Examples 1-5 can further include wherein the first and second protocols modulate an optical phase of the light signal.

In Example 7, the subject matter of Examples 1-6 can further include wherein the first protocol is mutually orthogonal with the second protocol.

In Example 8, the subject matter of Examples 1-7 can further include wherein the first protocol generates a subcarrier signal that alternates in frequency with a subcarrier signal generated by the second protocol.

In Example 9, the subject matter of Examples 1-8 can further include wherein the first and second protocols perform orthogonal frequency division multiplexing using an orthogonal basis set of subcarriers.

Example 10 is a method comprising: modulating a light signal at a downlink modulator to generate a first modulated light signal in response to downlink data using a first protocol; modulating the first modulated light signal at an uplink modulator in response to uplink data using a second protocol to generate a second modulated light signal; and demodulating the second modulated light signal at an uplink receiver to recover the downlink data and the uplink data; wherein the first and second protocols are asymmetric with respect to each other.

In Example 11, the subject matter of Example 10 can further include demodulating the first modulated light signal at a downlink receiver to recover the downlink data.

In Example 12, the subject matter of Examples 10-11 can further include wherein the first and second protocols comprise orthogonal frequency division multiplexing modulation schemes.

In Example 13, the subject matter of Examples 10-12 can further include wherein a first modulation spectra of the first modulated light signal overlaps with a second modulation spectra of the second modulated light signal wherein the first modulation spectra is orthogonal to the second modulation spectra.

In Example 14, the subject matter of Examples 10-13 can further include the first protocol encoding the downlink data in alternating subcarriers with the second protocol encoding the uplink data.

Example 15 is a system comprising: a light source to generate a light signal; a surface portion coupled to the light source, the surface portion comprising: a downlink modulator coupled to the light source and configured to modulate the light signal to generate, over a fiber optic channel, a first modulated light signal in response to downlink data and a first protocol; and an uplink receiver coupled to the fiber optic channel and configured to recover the downlink data and uplink data from a second modulated light signal; and a downhole portion coupled to the surface portion over the fiber optic channel, the downhole portion comprising: an uplink modulator configured to generate the second modulated light signal in response to the uplink data and a second protocol; and a downlink receiver, coupled to the fiber optic channel and configured to recover the downlink data, wherein the first protocol is asymmetric with respect to the second protocol.

In Example 16, the subject matter of Example 15 can further include a second fiber optic channel that couples the light source to the uplink modulator and a downlink mixer, wherein the light signal is a reference signal to the downlink mixer.

In Example 17, the subject matter of Examples 15-16 can further include wherein the surface control circuitry further comprises: a first coupler that couples the light source to the downlink modulator and the second fiber optic channel, wherein the coupler provides a second light signal from the light source; a polarization controller coupled to the coupler to provide a polarized light signal; a circulator that couples the first modulated light signal to the downhole control circuitry, the circulator further couples the second modulated light signal to an uplink mixer; and the uplink mixer that couples the polarization controller and the circulator to the uplink receiver, wherein the uplink mixer is configured to generate an uplink mixed light signal in response to the polarized light signal and the second modulated light signal; and the downhole control circuitry further comprises: a downlink mixer coupled to the downlink receiver; a second coupler that couples the light signal to the downlink mixer and the uplink modulator such that the downlink mixer is configured to generate a downlink mixed signal in response to the reference signal and the first modulated light signal; and a third coupler that couples the first modulated light signal to the downlink mixer and the second modulated light signal to the fiber optic channel.

In Example 18, the subject matter of Examples 15-17 can further include a frequency filter in the uplink receiver.

In Example 19, the subject matter of Examples 15-18 can further include a second fiber optic channel that couples the first modulated light signal to the uplink modulator and a downlink mixer, wherein the light signal is a reference signal to the downlink mixer.

In Example 20, the subject matter of Examples 15-19 can further include wherein the surface control circuitry further comprises: a first coupler that couples the light source to the downlink modulator and a polarization controller, the polarization controller configured to provide a polarized light signal; a second coupler that couples the first modulated light signal to the downhole control circuitry and a circulator; the circulator that couples the first modulated light signal to the downhole control circuitry, the circulator further couples the second modulated light signal to an uplink mixer; and the uplink mixer that couples the polarization controller and the circulator to the uplink receiver, wherein the uplink mixer is configured to generate an uplink mixed light signal in response to the polarized light signal and the second modulated light signal; and the downhole control circuitry further comprises: a downlink mixer coupled to the downlink receiver; a third coupler that couples the light signal to the downlink mixer and the uplink modulator such that the mixer is configured to generate a downlink mixed light signal in response to the reference signal and the first modulated light signal; and a fourth coupler that couples the first modulated light signal to the downlink mixer and the second modulated light signal to the fiber optic channel.

Although specific examples have been illustrated and described herein, it will be appreciated by those of ordinary skill in the art that any arrangement that is calculated to achieve the same purpose may be substituted for the specific examples shown. Various examples use permutations and/or combinations of examples described herein. It is to be understood that the above description is intended to be illustrative, and not restrictive, and that the phraseology or terminology employed herein is for the purpose of description. Combinations of the above examples and other examples will be apparent to those of skill in the art upon studying the above description.

What is claimed is:

1. A full-duplex borehole communication system comprising:

a light source to generate a light signal;

a downlink modulator coupled to the light source to modulate the light signal, in response to downlink data, using a first protocol to generate a first modulated light signal;

an uplink modulator coupled to the downhole modulator to modulate the first modulated light signal, in response to uplink data, using a second protocol to generate a second modulated light signal;

a downlink receiver coupled to the downlink modulator to demodulate the first modulated signal to recover the downlink data; and an uplink receiver coupled to the uplink modulator and configured to demodulate the second modulated light signal to recover the downlink data and the uplink data, wherein the first protocol is asymmetric with respect to the second protocol.

2. The system of claim 1, wherein the light source is located at one of either a downlink location or a formation surface location.

3. The system of claim 1, further comprising:

a circulator coupled to the downlink modulator and the uplink receiver; and a coupler coupled between the circulator and the downlink receiver and between the circulator and the uplink modulator;

wherein, the circulator is configured to couple the first modulated light signal to the coupler and the second modulated signal to the uplink receiver.

4. The system of claim 1, wherein the uplink receiver comprises:

a filter to separate the first modulated light signal from the second modulated light signal; and a plurality of demodulators to recover the downlink data and the uplink data from the first modulated light signal and the second modulator light signal, respectively.

5. The system of claim 1, wherein the first and second protocols modulate an optical amplitude of the light signal.

6. The system of claim 1, wherein the first and second protocols modulate an optical phase of the light signal.

7. The system of claim 1, wherein the first protocol is mutually orthogonal with the second protocol.

8. The system of claim 1, wherein the first protocol generates a subcarrier signal that alternates in frequency with a subcarrier signal generated by the second protocol.

9. The system of claim 1, wherein the first and second protocols perform orthogonal frequency division multiplexing using an orthogonal basis set of subcarriers.

10. A method comprising:

modulating a light signal at a downlink modulator to generate a first modulated light signal, in response to downlink data, using a first protocol;

modulating the first modulated light signal at an uplink modulator, in response to uplink data, using a second protocol to generate a second modulated light signal; and demodulating the second modulated light signal at an uplink receiver to recover the downlink data and the uplink data;

wherein the first and second protocols are asymmetric with respect to each other.

11. The method of claim 10, further comprising demodulating the first modulated light signal at a downlink receiver to recover the downlink data.

12. The method of claim 10, wherein the first and second protocols comprise orthogonal frequency division multiplexing modulation schemes.

13. The method of claim 12, wherein a first modulation spectra of the first modulated light signal overlaps with a second modulation spectra of the second modulated light signal wherein the first modulation spectra is orthogonal to the second modulation spectra.

14. The method of claim 10, further comprising the first protocol encoding the downlink data in alternating subcarriers with the second protocol encoding the uplink data.

15. A system comprising:

a light source to generate a light signal;

a surface portion coupled to the light source, the surface portion comprising:

a downlink modulator coupled to the light source and configured to modulate the light signal to generate, over a fiber optic channel, a first modulated light signal in response to downlink data and a first protocol; and an uplink receiver coupled to the fiber optic channel and configured to recover the downlink data and uplink data from a second modulated light signal; and a downhole portion coupled to the surface portion over the fiber optic channel, the downhole portion comprising:

an uplink modulator configured to generate the second modulated light signal in response to the uplink data and a second protocol; and a downlink receiver, coupled to the fiber optic channel and configured to recover the downlink data, wherein the first protocol is asymmetric with respect to the second protocol.

16. The system of claim 15, further comprising a second fiber optic channel that couples the light source to the uplink modulator and a downlink mixer, wherein the light signal is a reference signal to the downlink mixer.

17. The system of claim 16, wherein the surface control circuitry further comprises:

a first coupler that couples the light source to the downlink modulator and the second fiber optic channel, wherein the coupler provides a second light signal from the light source;

a polarization controller coupled to the coupler to provide a polarized light signal;

a circulator that couples the first modulated light signal to the downhole control circuitry, the circulator further couples the second modulated light signal to an uplink mixer; and the uplink mixer that couples the polarization controller and the circulator to the uplink receiver, wherein the uplink mixer is configured to generate an uplink mixed light signal in response to the polarized light signal and the second modulated light signal; and the downhole control circuitry further comprises:

a downlink mixer coupled to the downlink receiver;

a second coupler that couples the light signal to the downlink mixer and the uplink modulator such that the downlink mixer is configured to generate a downlink mixed signal in response to the reference signal and the first modulated light signal; and a third coupler that couples the first modulated light signal to the downlink mixer and the second modulated light signal to the fiber optic channel.

18. The system of claim 17, further comprising a frequency filter in the uplink receiver.

19. The system of claim 15, further comprising a second fiber optic channel that couples the first modulated light signal to the uplink modulator and a downlink mixer, wherein the light signal is a reference signal to the downlink mixer.

20. The system of claim 19, wherein the surface control circuitry further comprises:

a first coupler that couples the light source to the downlink modulator and a polarization controller, the polarization controller configured to provide a polarized light signal;

a second coupler that couples the first modulated light signal to the downhole control circuitry and a circulator;

the circulator that couples the first modulated light signal to the downhole control circuitry, the circulator further couples the second modulated light signal to an uplink mixer; and the uplink mixer that couples the polarization controller and the circulator to the uplink receiver, wherein the uplink mixer is configured to generate an uplink mixed light signal in response to the polarized light signal and the second modulated light signal; and the downhole control circuitry further comprises:

a downlink mixer coupled to the downlink receiver;

a third coupler that couples the light signal to the downlink mixer and the uplink modulator such that the mixer is configured to generate a downlink mixed light signal in response to the reference signal and the first modulated light signal; and a fourth coupler that couples the first modulated light signal to the downlink mixer and the second modulated light signal to the fiber optic channel.

* * * * *